United States Patent [19]

Stull

[11] 4,232,927

[45] Nov. 11, 1980

[54] ELECTRICAL CONNECTOR

[75] Inventor: John R. Stull, Lewisberry, Pa.

[73] Assignee: E. I. Du Pont de Nemours and Company, Wilmington, Del.

[21] Appl. No.: 21,568

[22] Filed: Mar. 16, 1979

[51] Int. Cl.[3] ..... H01R 11/20

[52] U.S. Cl. ..... 339/99 R

[58] Field of Search ..... 339/95 R, 96, 97 R, 339/97 P, 98, 99 R, 103 R, 176 MF, 176 MP, 97, 99, 103 M, 98

[56] References Cited

U.S. PATENT DOCUMENTS

| | | | |
|---|---|---|---|
| 4,040,705 | 8/1977 | Huber | 339/99 R |
| 4,066,316 | 1/1978 | Rollings | 339/91 R |

FOREIGN PATENT DOCUMENTS

| | | | |
|---|---|---|---|
| 1913991 | 10/1970 | Fed. Rep. of Germany | 339/97 R |
| 1913992 | 10/1970 | Fed. Rep. of Germany | 339/97 R |
| 2726226 | 12/1978 | Fed. Rep. of Germany . | |
| 1006621 | 10/1965 | United Kingdom | 339/97 P |

*Primary Examiner*—Howard N. Goldberg
*Assistant Examiner*—John S. Brown

[57] ABSTRACT

A connector containing multiple terminals having two contact ends. The ends of the terminals are separated by a bridge. One end has a pair of insulation-displacing contacts for piercing insulation surrounding discrete wire during insertion into a dielectric housing and the other end has a pin receiving contact or other element for contacting electrical circuits.

6 Claims, 14 Drawing Figures

Fig. 9
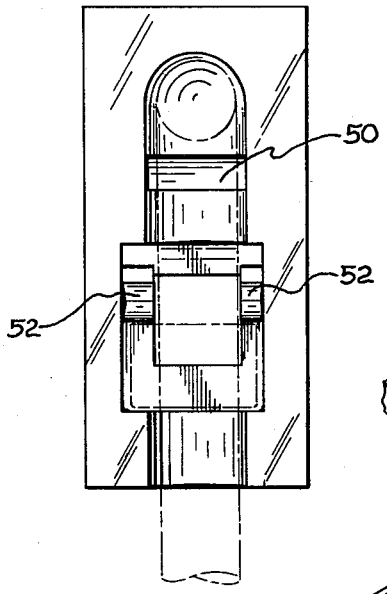
Fig. 10
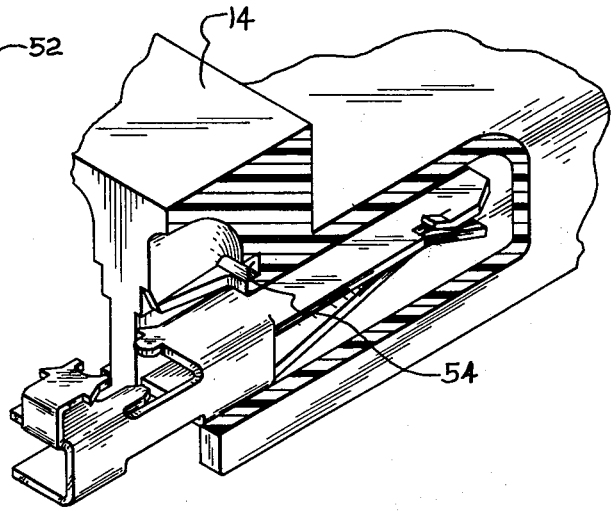
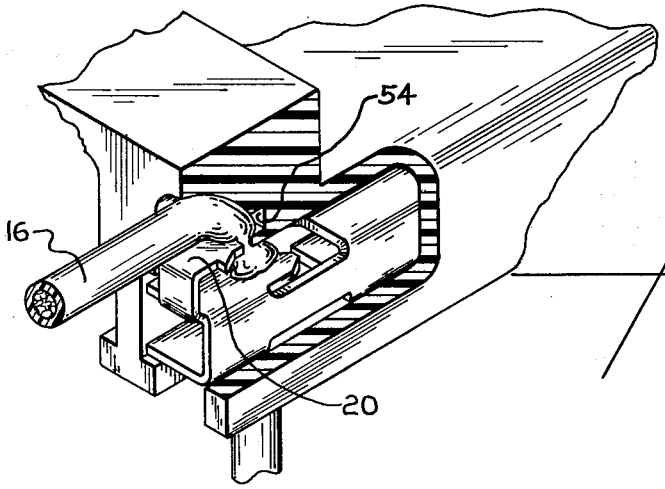
Fig. 11

ELECTRICAL CONNECTOR

TECHNICAL FIELD

This invention relates to the electrical connection of multiple discrete wires to other circuit elements. More particularly, it relates to connectors having multiple terminals with contacts at both ends, at least one end having a pair of insulation-displacement contacts capable of piercing a discrete wire upon insertion into a dielectric housing.

BACKGROUND ART

Considerable development has been made in recent years in mass termination of discrete wires, ribbon wires and coaxial cables. Many of these developments included insulation-displacement contacts for piercing the insulation and engaging the wire core. In the field of terminating discrete wires, a more convenient and inexpensive method of terminating such wires is still needed. The present invention solves that need by providing a more convenient and inexpensive means of mass terminating discrete wires.

DISCLOSURE OF INVENTION

The present invention provides an inexpensive method of mass terminating discrete wires. The wires are conveniently held by the connector until mass termination can take place. Moreover, the need for separate parts in the connector for strain relief is eliminated. These objectives are achieved by the use of a pair of insulation-displacement contacts that pierce the insulation and engage with the wire as the wire is seated within the connector housing.

BRIEF DESCRIPTION OF THE DRAWINGS

The best modes of the invention, together with their construction and methods of operation are illustrated in the drawings wherein:

FIG. 9 is an end view of the housing 14 in FIG. 2 looking into the opening which will receive the terminal.

FIG. 10 is a sectional perspective view of the terminal shown in FIG. 6 preloaded in the connector housing.

FIG. 11 is a sectional perspective view of the terminal shown in FIG. 6 fully seated in the connector housing after having pierced the insulation of the discrete wire.

DESCRIPTION OF APPARATUS

Figure 1:
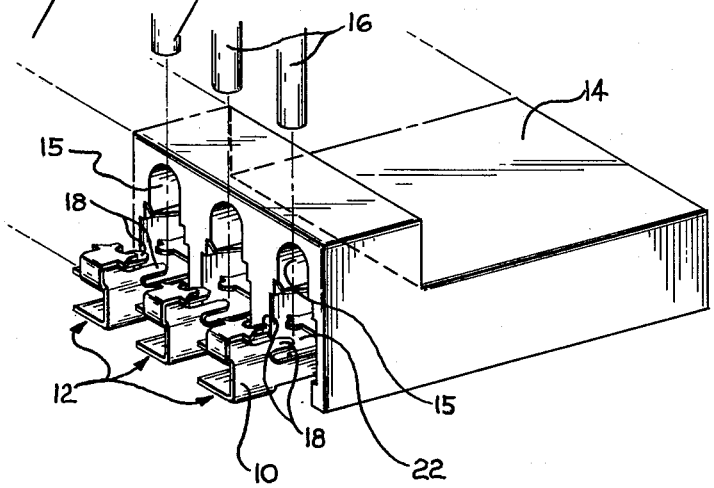
FIG. 1 is a perspective view of a connector with several contacts, each having a strain relief tab and each being preloaded in the connector housing.

In FIG. 1, a first contact end 10 of a terminal 12 protrudes from a dielectric housing 14 in a preloaded position, i.e., the insulated discrete wire 16 has not yet been pierced by insulation-displacement contacts 18. The first contact end 10 of the terminal 12 also has a strain relief 20 spaced above the pair of insulation-displacement contacts 18. The first contact end also contains a recessed area 22 adjacent the contacts 18 for receiving an insulated discrete wire 16. The wires 16 are inserted into the recessed area 22 and the terminals 12 are then pushed into the housing 14 to pierce the insulations and seat the wires in the slots between the tines of the contact 18.

Figure 2:
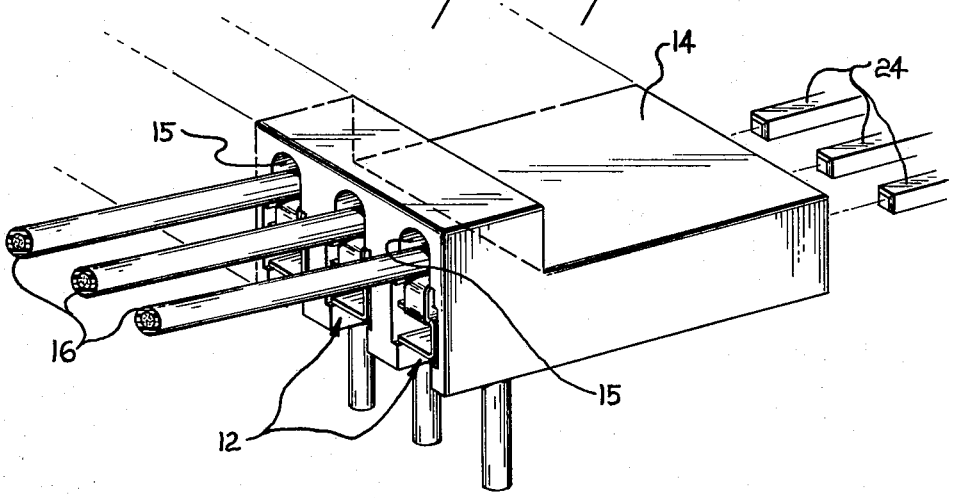
FIG. 2 is a perspective view of the same connector of FIG. 1 after insertion of the discrete wire and termination. The contacts are shown in their fully seated position within the housing.

FIG. 2 shows the position of the wire 16 and the terminal 12 after being pushed into the housing 14. One end of the wire 16 exits from the housing 14 above the terminal 12 from opening 15 and the other end from below the terminal 12. The lower portion may be cut level with the bottom of the housing 14 if it is desired to have only one wire connection from the connector. The male pin 24 is shown ready for insertion.

Figure 3:
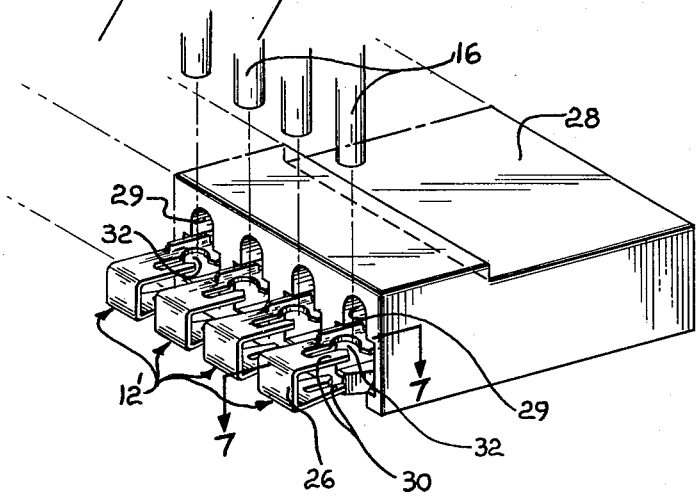
FIG. 3 is a perspective view of another connector of the invention. The contacts are in their preloaded position relative to the connector housing.

In FIG. 3, a modified first contact end 26 of a terminal 12' protrudes from a modified dielectric housing 28 in a preload position, i.e., the insulated discrete wire 16 has not yet been pierced by the pair of insulation-displacement contacts 30. The recessed area 32 adjacent the contact 30 receives the wire 16. The terminal 12' is then pushed into the housing 28 and the insulation of the wire is pierced by the contacts 30. The opening 29 in housing 28 provides adequate strain relief for the wire 16.

Figure 4:
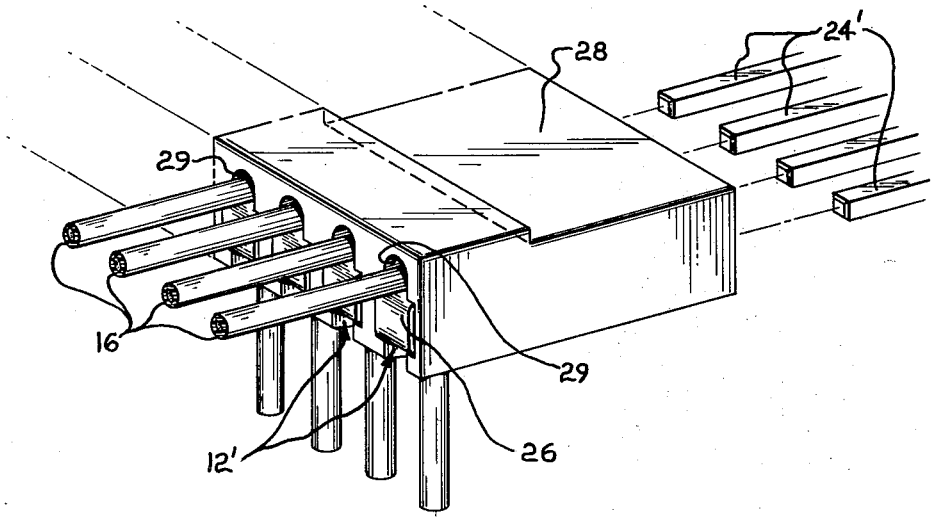
FIG. 4 is a perspective view of the same connector as in FIG. 3 after having the discrete wire inserted and the contacts fully seated within the connector housing.

FIG. 4 shows the position of the wire 16 exiting from the housing 28 through the opening 29 above the terminal 12' and also exiting below the terminal 12'. The wire exiting below the terminal 12' may be cut level with the bottom of the housing 28 if it is desired to have only one connection per wire. As in FIG. 2, the male pin 24' is shown ready for insertion.

Figure 5:
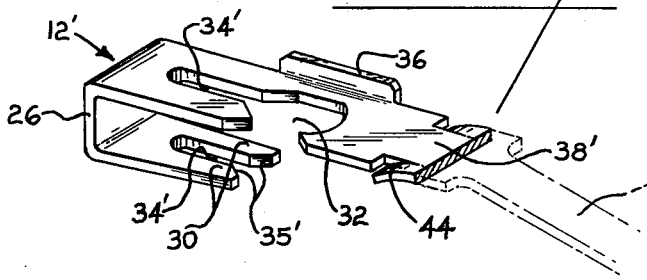
FIG. 5 is a perspective view of the terminals shown in FIGS. 3 and 4.

FIG. 5 shows the terminal 12' and the pair of contacts 30 without a strain relief. Each contact 30 has a slot 34' slightly narrower than the wire expected to be seated. The insulated wire is placed within the recessed area 32. As the terminal is pushed into the housing, the wire is guided by the beveled openings 35 into the slot 34'. A tab 36 is bent over to a position perpendicular to the top of the terminal to provide strength to the edge of the recessed area 32. A bridge 38' separates the first contact end 26 from the second contact end 40' of terminal 12'. This second contact end 40' is a single beam female drawn in phantom. A lance 44 on each side of the bridge 38 is used to retain the inserted terminal 12' in the housing.

Figure 6:
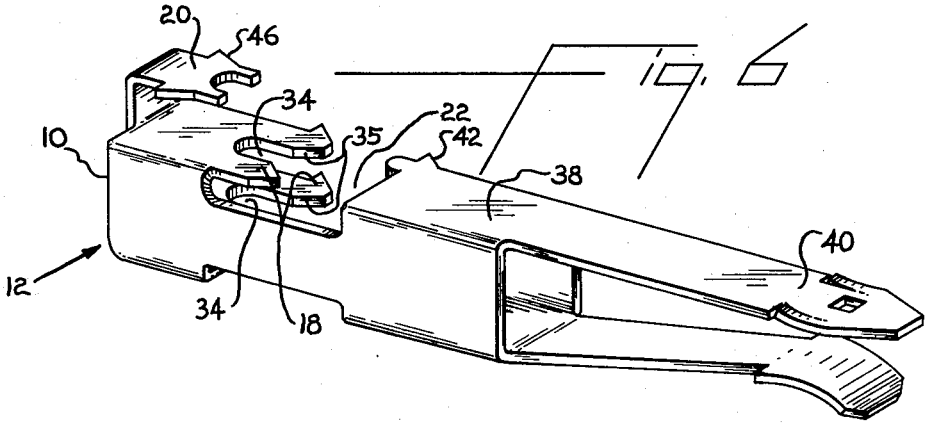
FIG. 6 is a perspective view of the terminals shown in FIGS. 1 and 2.

In FIG. 6, the terminal 12 shows its first contact end 10 as having, in addition to the contacts 18, a strain relief 20. Each contact 18 has a slot 34 slightly narrower than the wire expected to be seated. The insulated wire is placed within the recessed area 22. As the terminal is pushed into the housing the wire is guided by the beveled openings 35 into the slot 34. The strain relief 20 engages the insulation and prevents strain from being placed on the seated wire within the slots 34. The terminal also has a retention barb 42 and a bridge 38 to the second contact end 40. FIG. 6 shows the second contact as a standard dual beam contact for receiving a pin.

Figure 7:
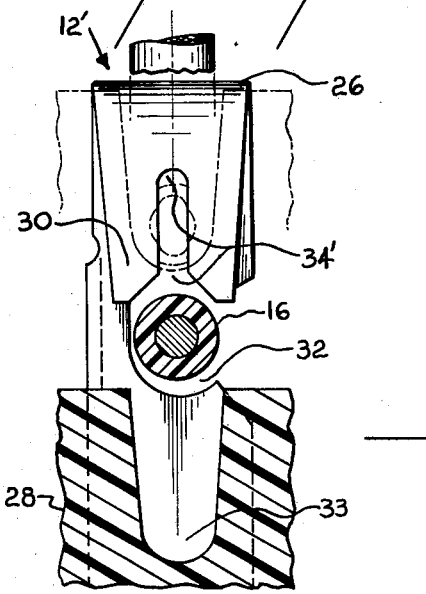
FIG. 7 is a sectional view along line 7—7 of FIG. 3 showing the bottom of the preloaded first contact side of the terminal.
Figure 8:
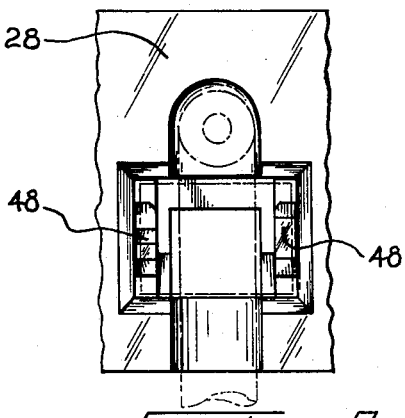
FIG. 8 is an end view of the housing 28 in FIG. 4 looking into the opening which will receive the terminal.

In FIG. 7, the bottom of the first contact end 26 of the terminal 12' is shown in the preload position with the insulated wire in the recessed area 32. Pushing the terminal into the housing 28 forces the wire 16 into the slot 34' between the contacts 30 and seats the wire. The wire exits from the terminal bottom portion in the area 33 after full seating of the terminal in the housing. The terminal containing the seated wire is stopped by the wire squeezed against the housing in area 33, as well as by the squeezing of the wire in the housing above the terminal 12' shown in FIG. 13 in opening 55. It is also stopped by the ends of the ribs 48 as shown in FIG. 8. The ribs 48 act to pre-stress the beams 40' as shown in U.S. Pat. No. 4,066,316.

FIG. 9 shows the stops 50 and 52 for the terminal employed in FIG. 1. Stops 52 are the ends of the ribs which act to pre-stress the beams 40 as shown in FIG. 6.

In FIG. 10, the pocket 54 in housing 14 is shown. As the insulated wire is pierced (see FIG. 11) the wire is jammed into the pocket 54 and the forward motion of the terminal is stopped. The strain relief 20 prevents any injury to the connection if the insulated wire 16 is pulled.

Figure 12:
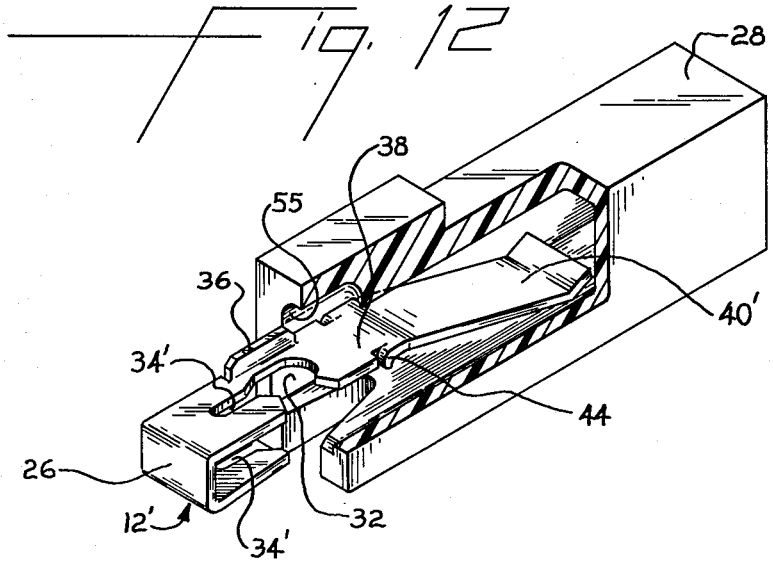
FIG. 12 is a sectional perspective view of the terminal shown in FIG. 5 preloaded in the connector housing.
Figure 13:
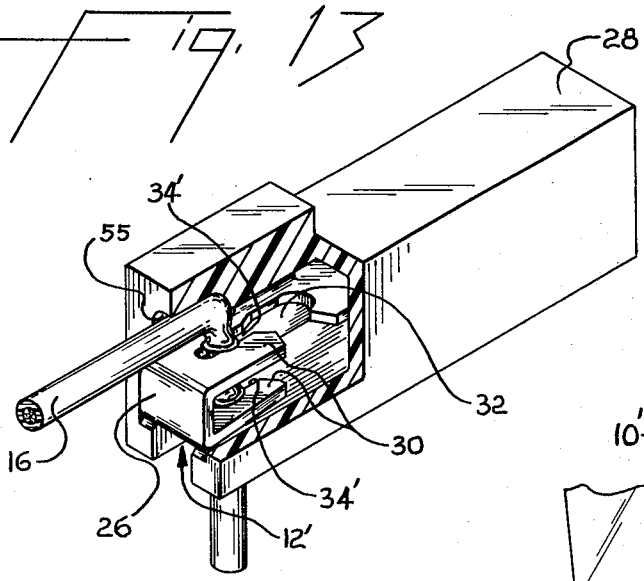
FIG. 13 is a sectional perspective view of the terminal shown in FIG. 5 fully seated in the connector.

In the alternate terminal 12', the housing provides adequate strain relief. Referring to FIG. 12, the pocket 55 in the housing 28 traps the wire and aids in the ability of the contacts 30 to pierce the insulation. The wire exiting from the bottom of the terminal as shown in FIG. 13 is jammed into the housing opening 33 (FIG. 7) to prevent further movement of the terminal after the wire is seated.

Figure 14:
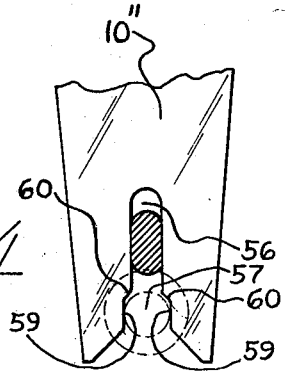
FIG. 14 is an end view of an alternate embodiment of the insulation piercing contact shown in FIG. 7.

FIG. 14 shows an alternate embodiment of the contact slot width as compared to the contacts in FIG. 7. The slot length 57 is the same diameter as the wire core and has sharp edges 59 to pierce the insulation. The terminal 10'' is stamped in a manner so slot length 57 is formed with sharp edges 59 and there is a generous lead in radius 60 reducing down to the width of slot length 56. Slot length 56 is slightly less in width than slot length 57 and the wire diameter.

The two width sizes are used in the insulation-displacement contact 10'' so that the insulation is not inordinately compressed before shearing takes place. This design of these contacts reduces the normal forces on the contact tines. Moreover, it reduces the amount of metal scooped or plowed from the wire core.

The dielectric housing employed in the connector of this invention can be molded in a fully automatic injection molding machine using a thermoplastic such as nylon, polycarbonate or glass filled polyester.

The terminal can be stamped from a super strength brass alloy, phosphor bronze alloy or a copper nickel tin alloy. The terminals can be stamped in a high-speed progressive die from a single strip of any one of the aforementioned alloys.

Having thus described the invention, what is claimed as new and desired to be secured by Letters Patent is:

1. An electrical terminal having first and second contact ends interconnected by an intermediate bridge, said first contact end having a pair of spaced slotted insulation-displacing contacts, one above the other, said second contact end having means for engaging contact elements in other electrical circuits, said bridge being recessed in an area adjacent said first contact to present an access for an insulated wire and the slots in said insulation-displacing contacts having wire entrance openings adjacent and opening into the recess in said bridge, the pair of insulation-displacing contacts positioned so that they pierce the same insulated wire.

2. An electrical terminal according to claim 1 wherein said second contact end is a single beam element.

3. An electrical terminal according to claim 1 wherein said second contact end is a dual beam element.

4. An electrical terminal according to claim 1 wherein an integral strain relief element is spaced from the insulation-displacing contacts.

5. An electrical connector comprising a dielectric housing having multiple parallel elongated spaced receiving channels open at both ends, each channel having interior ribs to orient and pre-stress an electrical terminal having first and second contact ends interconnected by an intermediate bridge, said first contact end having a pair of spaced slotted insulation-displacing contacts, one above the other, said second contact end having means for engaging contact elements in other electrical circuits, said bridge being recessed in an area adjacent said first contact to present an access for an insulated wire and the slots in said insulation-displacing contacts having wire entrance openings adjacent and opening into the recess in said bridge, the pair of insulation-displacing contacts positioned so that they pierce the same insulted wire.

6. An electrical connector according to claim 5 having in the housing a recessed slot below the base of the first contact end and a grooved opening above the top of the first contact end to provide strain relief and facilitate entrance and exit of a wire in engagement with said first contact end.

* * * * *